United States Patent [19]

Takase

[11] Patent Number: 4,489,763

[45] Date of Patent: Dec. 25, 1984

[54] LEVELING DEVICE OF DOBBY MACHINE

[75] Inventor: Yasuhide Takase, Nagoya, Japan

[73] Assignee: Yamada Dobby Co., Ltd., Bisai, Japan

[21] Appl. No.: 444,893

[22] PCT Filed: Apr. 9, 1982

[86] PCT No.: PCT/JP82/00117

§ 371 Date: Nov. 12, 1982

§ 102(e) Date: Nov. 12, 1982

[87] PCT Pub. No.: WO82/03640

PCT Pub. Date: Oct. 28, 1982

[30] Foreign Application Priority Data

Apr. 10, 1981 [JP] Japan ..... 56-52260

[51] Int. Cl.[3] ..... D03D 49/00; D03C 1/14; D03C 13/00

[52] U.S. Cl. ..... 139/329; 139/68; 139/331

[58] Field of Search ..... 139/329, 330, 331, 332, 139/68

[56] References Cited

U.S. PATENT DOCUMENTS 3,951,176 4/1976 Koyama ..... 139/331 X

FOREIGN PATENT DOCUMENTS 31113 9/1964 German Democratic Rep. ..... 139/331

507111 9/1930 Fed. Rep. of Germany ..... 139/329

2428693 1/1980 France ..... 139/68

25-3192 9/1950 Japan .

*Primary Examiner*—James Kee Chi

*Attorney, Agent, or Firm*—Armstrong, Nikaido, Marmelstein & Kubovcik

[57] ABSTRACT

This invention relates to a leveling device in which a shaft (7) of a card cylinder (6) is supported by a bearing of a card cylinder bracket, base portion of the card cylinder bracket is pivotally attached to a machine frame, and the card cylinder bracket can be rocked between working attitude and leveling attitude. The card cylinder bracket is urged into the leveling attitude by a spring or the like, and it is held in the working attitude and the leveling attitude by a cam or a crank arm which is disposed near the card cylinder (6) and installed to a parallel shaft being in parallel to the cylinder.

7 Claims, 2 Drawing Figures

LEVELING DEVICE OF DOBBY MACHINE

DESCRIPTION

1. Technical Field

This invention relates to a leveling device which is used to equalize level of all warps moved in shedding motion by a dobby machine installed on a loom.

2. Background Art

In general, when a heald frame is installed to a dobby machine in a weaving preparation step or warp is passed through a heald in the installed heald frame or warp being cut during the weaving work is connected, operation to equalize level of all heald frames, that is, leveling operation is performed so as to facilitate the work.

A leveling device in dobby machines is usually constituted so that a card cylinder is moved away from or close to a fish-lever. In a dobby machine, an endless card wrapped around the rotating card cylinder is provided with pegs planted thereon corresponding to fabric pattern, and when the card cylinder is in normal working attitude the heald frame connected to the fish-lever instructed by the peg solely rises and other heald frames remain in falling position. Thereby if the card cylinder is moved away from the fish-lever, i.e. in the leveling attitude, command from the peg is not delivered to the fish-lever irrespective of existence of the peg. Accordingly, all heald frames remain in the falling position and level of all warps is equalized thus the leveling is effected.

Mechanism to transfer position of a card cylinder is usually constituted in that base portion of a card cylinder bracket is fixed to a rocking shaft supported by a machine frame, a shaft of a card cylinder is supported by a bearing formed on the top end of the card cylinder bracket, and the card cylinder bracket is rocked and transferred between the working attitude and the leveling attitude.

In such device of prior art, following mechanism is used in order to transfer the card cylinder bracket between the working attitude and the leveling attitude and to hold it in the corresponding position. In this mechanism, a lever is fixed to the rocking shaft, the cylinder bracket is rocked by operating the lever, and the lever is provided with notch means thereby the lever is held in a prescribed position by the notch means. In the above mentioned device, however, since urging force supplied at the fish-lever is delivered through the peg to the card cylinder, it has disadvantages in that large force is required for rocking operation of the lever and operation for engaging or detaching the notch is complicated and troublesome.

DISCLOSURE OF INVENTION

This invention relates to a leveling device which is constituted in that a card cylinder is supported to a bearing formed at the top end of a card cylinder bracket, base portion of the card cylinder bracket is pivotally attached to a machine frame, and the card cylinder bracket can be rocked between working attitude in which the fish-lever is acted by a peg planted on a card wrapped around the card cylinder and leveling attitude in which the fish-lever is not acted by the peg being away from the position, wherein the card cylinder bracket is urged into the leveling attitude by urging means such as a spring, a cam or a crank arm which is pivotally attached to the heald frame near the card cylinder acts on the bearing of the card cylinder bracket to move it and co-operates with the urging means so as to hold the card cylinder bracket in the working attitude and the leveling attitude.

An object of this invention is to provide a leveling device which can be operated by small force. Another object of this invention is to provide a leveling device in which notch means is not required.

Above-mentioned and other objects and features of this invention will be apparent from the following description referring to the accompanying drawings.

BEST MODE FOR CARRYING OUT THE INVENTION

Figure 1:
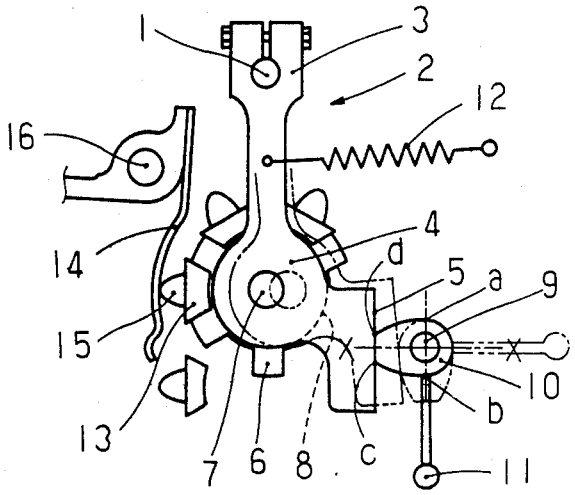
FIG. 1 is a front view illustrating a first embodiment of this invention.

First Embodiment (FIG. 1)

A rocking shaft 1 is rotatably supported to a machine frame (not shown). A base portion 3 formed on upper side of a first card cylinder bracket 2 is fixed on the rocking shaft 1, and one end of a shaft 7 of a card cylinder 6 is rotatably supported to a bearing 4 formed on lower side of the bracket 2. A slide surface 5 is disposed in slant lower side of the bearing 4, and formed in the vertical direction and perpendicular to the figure plane. Other end of the shaft 7 of the card cylinder 6 is supported by a second card cylinder bracket 8, thereby the shaft 7 is directed in parallel to the rocking shaft 1. The second card cylinder bracket 8 is formed in similar manner to the first card cylinder bracket 2 except that it is formed as shown in dashed line without the slide surface 5.

A parallel shaft 9 which is opposed to the slide surface 5 and in parallel to the card cylinder 6 is supported to the machine frame. A cam 10 is fixed to the parallel shaft 9, and cam curve of the cam 10 is composed of a semicircle a-b about the axial center of the parallel shaft 9, a line segment c-d being opposite to the semicircle a-b and perpendicular to the axial line x—x passing through the center of the semicircle a-b and having distance from the axial center being longer than the radius of the semicircle a-b by prescribed dimension and being halved by the axial line x—x, and circular arcs b-c and a-d, and is formed symmetrically with respect to the axial line x—x. An operating lever 11 is fixed to the parallel shaft 9 and directed perpendicular to the axial line x—x. A tension coil spring 12 is connected to the first card cylinder bracket 2 at one end and to the machine frame at other end, and urges the first card cylinder bracket 2 and the second card cylinder bracket 8 in counterclockwise direction. Reference numeral 13 designates a card, and a plurality of cards 13 are connected in endless form and wrapped around the card cylinder 6. A plurality of pegs 15 are planted on each card 13 in longitudinal direction (perpendicular to the figure plane) corresponding to the fabric pattern. A plurality of fish-levers 14 are supported on a stationary shaft 16 fixed to the machine frame and opposed to positions where the pegs 15 are to be planted, so that the fish-levers 14 are rocked and receive command by the pegs 15 which move as the card cylinder 6 rotates.

In working attitude of the device as shown by solid line in FIG. 1, the operating lever 11 is directed downwards and the slide surface 5 is contacted under pressure with the line segment c-d of the cam curve. In this attitude each fish-lever 14 receives command so that it is rocked when the peg 15 is planted on the card 13 which is moved by the card cylinder 6 rotating as above described and it stands still when the peg 15 is not planted, thereby the dobby machine can perform shedding motion. In this attitude the card cylinder brackets 2, 8 are urged in counterclockwise direction by the coil spring 12 and the fish-lever 14. Since the vertical halving line of the line segment c-d contacting under pressure with the slide surface 5 passes through the axial center of the parallel shaft 9, attitude of the card cylinder bracket 2 is securely held in working attitude.

If the operating lever 11 is rotated counterclockwise by 90°, as shown by dash-and-dot line in FIG. 1 the card cylinder brackets 2, 8 are rotated counterclockwise so that portion a of the cam curve of the cam 10 is contacted under pressure with the slide surface 5 thereby the device is transferred in leveling attitude. Even if the card cylinder 6 is rotated in this attitude, since any peg 15 does not act on the fish-lever 14, all fish-levers 14 are held in stantionary state thereby all heald frames are in downward attitude and leveling is performed. The card cylinder brackets 2, 8 are urged in counterclockwise direction by the spring 12 also in this leveling attitude. Since the slide surface 5 is contacted under pressure with the semicircle a-b having the smallest radius in the cam surface of the cam 10, the card cylinder brackets 2, 8 are held stably in the attitude.

When the operating lever 11 is operated, it receives resistance based on urging force of the spring 12 and pressure from the fish-lever 14. However, since the parallel shaft supporting the cam 11 is disposed near the card cylinder 6 and lever ratio between the operating lever 11 and the cam 10 is large, the operating lever 11 can be operated by small force.

Figure 2:
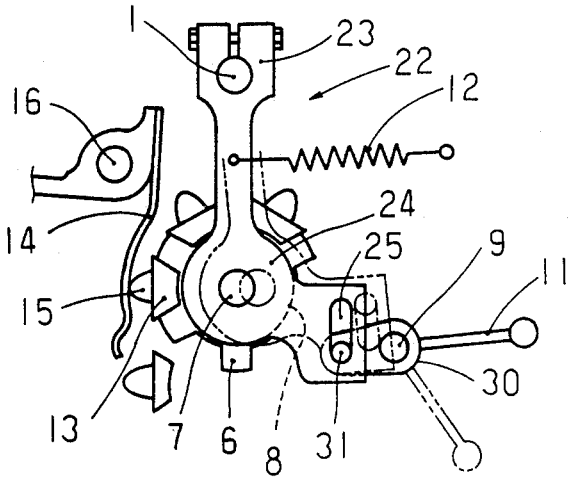
FIG. 2 is a front view illustrating a second embodiment of this invention.

Second Embodiment (FIG. 2)

In FIG. 2, members having like reference numerals as in FIG. 1 are formed in similar manner to the first embodiment. A base portion 23 of a first card cylinder bracket 22 is fixed on a rocking shaft 1, and a bearing 24 supports a shaft 7 of a card cylinder 6. An oval hole or slot 25 in the vertical direction is perforated in slant lower side of the bearing 24, and a crank pin 31 which is planted on a crank arm 30 fixed to a parallel shaft 9 is fitted to the oval hole 25 and slidable therealong. The lower end position of the oval hole 25 is determined so that the crank arm 30 is rotated counterclockwise and the card cylinder bracket 22 is moved to the left dead point by the crank pin 31 and then the crank pin 31 is contacted with the lower end of the oval hole 25 at a position where the crank arm 30 is slightly rotated counterclockwise. The upper end position of the oval hole 25 is determined so that the crank arm 30 is rotated clockwise and the card cylinder bracket 22 is moved to the right by the crank pin 31 and then the crank pin 31 is contacted with the upper end of the oval hole 25 in leveling attitude.

In this embodiment, if the operating lever 11 is rotated counterclockwise and the crank pin 31 is contacted with the lower end of the oval hole 25 as shown by solid line in FIG. 2, the card cylinder brackets 22, 8 are in working attitude and the peg 15 planted on the card 13 supplies command to the fish-lever 14 and the dobby machine is ready to shedding motion. In this state the card cylinder brackets 22,8 are urged in counterclockwise direction by the spring 12, thereby the oval hole 25 urges the crank pin in counterclockwise direction. Since the crank pin 31 is contacted with the lower end of the oval hole 25, the crank pin 31 is not rotated and the card cylinder brackets 22, 8 are held stably in working attitude. If the operating lever 11 is rotated clockwise and the card cylinder brackets 22, 8 are rocked in counterclockwise direction and transferred into leveling attitude as shown by dash-and-dot line in FIG. 2, the peg 15 planted on the card 13 goes away from the fish-lever 14 and cannot supply command and all fish-levers are in stationary state thereby leveling is applied to all warps when all heald frames are in downward position. In this state, since the crank pin 31 is contacted under pressure with the upper end of the oval hole 25 and cannot be rotated, the card cylinder brackets 22, 8 are supported by the crank pin 31 and held stably in leveling attitude. Moreover, since the parallel shaft 9 is disposed near the card cylinder 6 and lever ratio between the crank arm 30 and the operating lever 11 is large, the operating lever 11 can be operated by small force.

I claim:

1. A leveling device for a dobby machine, having card cylinder bracket means pivotally attached to the machine frame, and a card cylinder mounted on said bracket means, wherein said bracket means has an operating state for positioning said card cylinder such that pegs thereon contact fish levers of the machine and a leveling state for positioning said card cylinder such that pegs thereon are not in contact with the fish levers whereby the heald frames of the machine are leveled, said leveling device comprising a shaft positioned parallel to said card cylinder; a cam means movably mounted on said shaft, said cam means having first and second cam surface portions; said bracket means including slide surface means for contacting said cam surface portions, and remaining stably in contact therewith and urging means for urging said bracket means towards said cam means, wherein when said cam means are moved to a first position such that said slide surface means contacts said first cam surface portion, said bracket means are positioned in said operating state, and when said cam means are moved to a second position such that said slide surface means contacts said second cam surface portion, said bracket means are moved to said leveling state.

2. A leveling device as set forth in claim 1 wherein said urging means is a spring.

3. A leveling device as set forth in claim 1 wherein said slide surface means is a flat surface.

4. A leveling device as set forth in claim 1 wherein said cam means includes a handle for rotating said cam means about said shaft.

5. A leveling device for a dobby machine having card cylinder bracket means pivotally attached to the machine frame, and a card cylinder mounted on said bracket means, wherein said bracket means has an operating state for positioning said card cylinder such that pegs thereon contact fish levers of the machine and a leveling state for positioning said card cylinder such that pegs thereon are not in contact with the fish levers whereby the heald frames of the machine are leveled, said leveling device comprising a shaft positioned parallel to said card cylinder; crank arm means movably mounted on said shaft; a crank pin extending from said crank arm means; said bracket means including a slot therein having first and second ends therein, said crank pin engaging said slot and remaining stably in contact with the first or second end thereof; and urging means for urging said bracket means towards said crank arm means, wherein when said crank arm is moved to a first position such that said crank pin is positioned at the first end of said slot, said bracket means are positioned in said operating state, and when said crank arm is moved to a second position such that said crank pin is positioned at the second end of said slot, said bracket means are moved to said leveling state.

6. A leveling device as set forth in claim 5 wherein said urging means is a spring.

7. A leveling device as set forth in claim 5 wherein said crank arm means includes a handle for rotating said crank arm means about said shaft.

* * * * *